United States Patent [19]

Behr et al.

[11] Patent Number: 4,771,949

[45] Date of Patent: Sep. 20, 1988

[54] APPARATUS FOR ELECTROSTATIC COATING OF OBJECTS

[75] Inventors: Hans Behr, Stuttgart; Kurt Vetter, Remseck; Rolf Schneider, Burgstetten; Fred Luderer, Leutenbach, all of Fed. Rep. of Germany

[73] Assignee: Hermann Behr & Sohn GmbH & Co., Fed. Rep. of Germany

[21] Appl. No.: 821,860

[22] Filed: Jan. 22, 1986

Related U.S. Application Data

[63] Continuation-in-part of Ser. No. 665,932, Oct. 29, 1984, abandoned.

[51] Int. Cl.[4] ..... B05B 5/04

[52] U.S. Cl. ..... 239/703

[58] Field of Search ..... 239/699-704, 239/706, 707, 296, 105

[56] References Cited

U.S. PATENT DOCUMENTS 2,960,273 11/1960 Croskey et al. ..... 239/704
3,393,662 7/1968 Blackwell ..... 239/703
3,408,985 11/1968 Sedlacsik, Jr. ..... 239/706 X
4,555,058 11/1985 Weinstein et al. ..... 239/296 X
4,589,597 5/1986 Robisch et al. ..... 239/703

*Primary Examiner*—Andres Kashnikow
*Attorney, Agent, or Firm*—Reising, Ethington, Barnard, Perry & Milton

[57] ABSTRACT

An electrostatic spray coating assembly (10) for atomizing electrically conductive material comprises a rotary atomizer spray head (12) having an annular atomizing spraying edge (14). An external housing (22) supports the spray head (12) and a feed line (18) supplies the material from a supply system to the spraying edge (14) of the spray head (12). The feed line (18) and the material supplied thereby and the spray head (12) are electrically grounded. Three needle-shaped charging electrodes (36) are in spaced relationship circumferentially at uniform angular intervals with respect to the spray head (12). The charging electrodes (36) are connected to a source of high voltage potential for producing an electrical field charging the conductive material. The charging electrodes (36) are positioned from the spraying edge (14) of the spray head (12) a predetermined radial distance (R) at least twice the diameter (d) of the spraying edge (14) of the spray head (12).

12 Claims, 2 Drawing Sheets

APPARATUS FOR ELECTROSTATIC COATING OF OBJECTS

RELATED APPLICATION

This application is a continuation-in-part of application Ser. No. 665,932 filed Oct. 29, 1984, now abandoned.

TECHNICAL FIELD

The subject invention relates to spray guns and, particularly, spray guns utilizing conductive coating material in an electrostatic spray coating system.

BACKGROUND ART

Electrostatic spray systems suitable, for example, for painting automobile bodies, have existed for some time as disclosed in European Pat. No. 9,032,391. This has been accomplished by applying a high voltage potential to the spray head of a spraying apparatus in order to produce an electrical field between the spray head and the grounded object to be coated to charge the sprayed coating material.

The problem with such spraying apparatus is that when a coating material of relatively good conductivity is used, such as a so-called water enamel, the insulation resistance through the line connecting the spray head to the paint storage system is too low for a storage system at ground potential. This problem may be solved by insulating the entire storage system from the ground potential. However, this is undesirable, especially if, when changing colors, the storage system comprises a plurality of storage tanks. Apart from the considerable cost of insulating, the capacity of an extensive storage system may be so large that the corresponding charging energy ($\frac{1}{2}$ $CU^2$) may be too high, creating the danger of an explosive discharge at the spray head. Moreover, even if largely solvent-free paint is used, this danger cannot be completely eliminated. Further the tanks which are at a high electrical potential cannot be topped up without switching off the power, unless costly additional equipment, in the form of intermediate tanks, or the like, is used, as disclosed in German Pat. No. 2,900,660. Also, many of these known systems are expensive since they utilize uneconomical high power voltage sources.

The subject invention is related to an apparatus as disclosed in U.S. Pat. No. 3,393,662 in the name of Ronald J. Blackwell. His apparatus has a grounded rotary atomizer and a plurality of externally charging electrodes arranged circumferentially around the spraying device and connected to a high voltage source.

The problem with such spraying devices is that it is very difficult to protect the spraying device and charging electrodes from rapid contamination by paint particles due to a substantially radial spraying component from the spray head. These contaminated particles not only impair the electrical field, but after a color change, may also contaminate the article to be coated when subsequently used. Moreover, a possibility of the painting efficiency being substantially lower than that of conventional devices having their spray head connected to a high voltage potential exists.

STATEMENT OF INVENTION AND ADVANTAGES

An electrostatic spray coating assembly for atomizing electrically conductive material and depositing the atomized material upon the surface of an object comprises a rotary atomizer spray head having an atomizing spray edge for centrifugally atomizing the material and projecting the atomized material radially therefrom. An external housing supports the spray head. A feed line means is used for supplying material from a supply system to the spraying edge of the spray head. The feed line means and the material supplied thereby and the spray head are electrically grounded. The electrode means in spaced relationship circumferentially at uniform angular intervals with respect to the spray head is connected to a source of high voltage potential for producing an electrical field to charge the conductive material. The electrode means has a radial distance between the electrode means and the spraying edge of the spray head at least greater than twice the diameter of the spraying edge of the spray head.

Accordingly, the subject invention may be utilized for highly conductive spray materials. The subject invention achieves an optimal compromise between satisfactory efficiency of paint application and minimal contamination by using high voltage external electrodes in an optimal arrangement with regard to the charging field. At the same time the subject invention insures uniform distribution of the electrical field at the object to be coated, i.e., uniform coating. Further, expensive insulation is not required, resulting in a less costly spraying device. Further, the paint application efficiency is high, producing an inexpensive spraying device which largely eliminates contamination of the electrodes and the spraying device. Finally, the subject invention uses a relatively low operating current.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
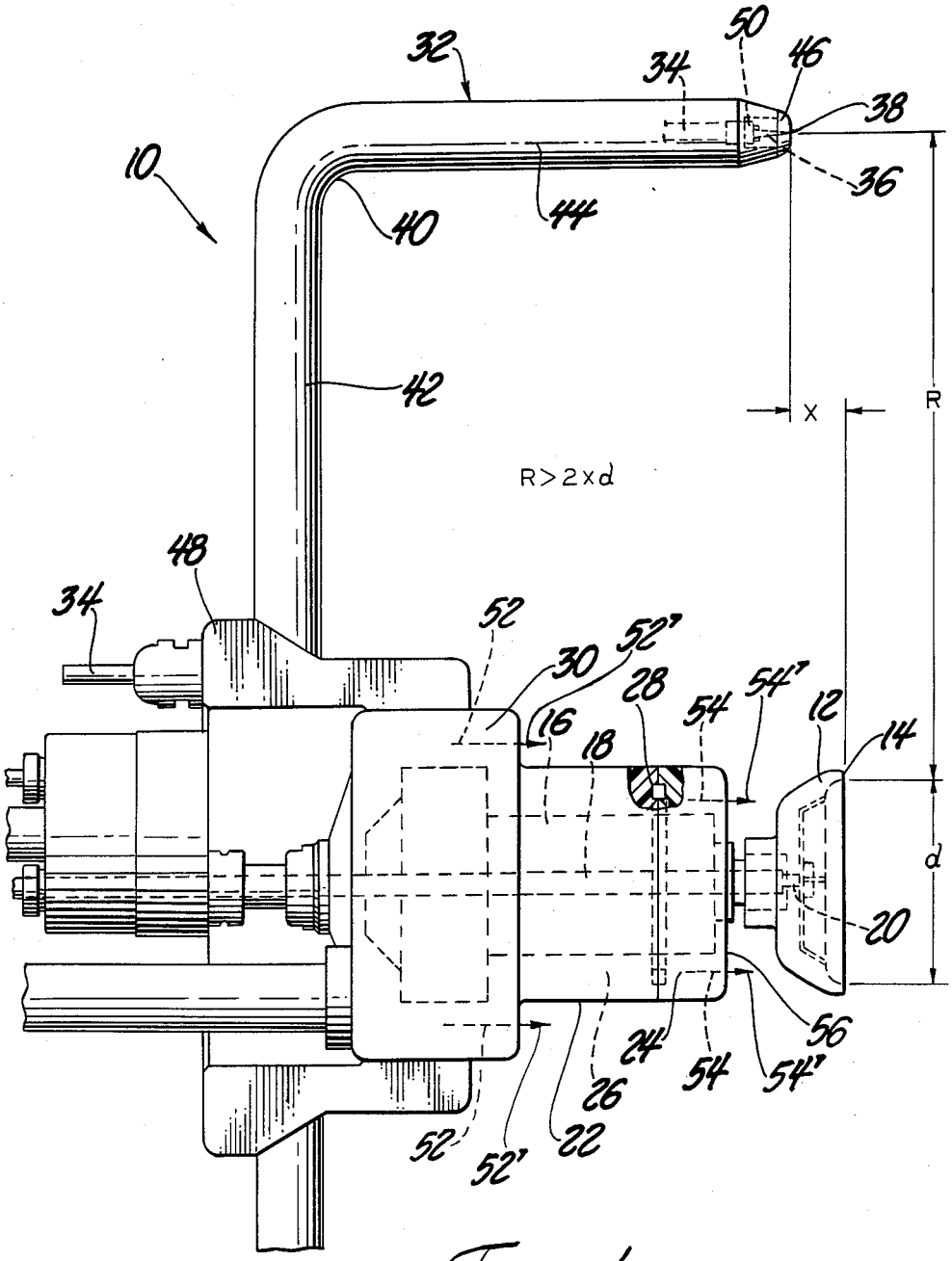
FIG. 1 is an elevational view of the subject invention.

An electrostatic spray coating assembly for atomizing electrically conductive material and depositing the atomized material upon the surface of an object is generally shown at 10 in FIG. 1. The assembly 10 comprises a rotary atomizer bell plate or spray head 12 having an atomizing spraying surface or edge 14 for centrifugally atomizing the material and projecting the atomized material radically therefrom. The spraying edge 14 has a diameter d defined in the spray head 12 as the point from which the atomized material moves radially away from the spray head 12. In other words, the diameter d of the spraying edge 14 is less than the diameter of the spray head 12. The bell plate 12 may be made of plastic, for example, acrylic glass. In most cases, a conventional metal bell plate 12 is preferred.

The assembly 10 includes a rotary atomizer driving and mounting unit 16 for driving the spray head 12 at a high speed (e.g. 30,000 RPM). Preferably, for design and production reasons, the rotary atomizer driving and mounting unit 16 consists mainly of metal.

The assembly 10 also includes feed line means 18 for supplying or carrying the paint or other coating material from a supply or storage system (not shown) to the spray head 12. Feed line means 18 comprises a line 18 formed, for example, by a grounded metal tube, or the like, along the axis of the assembly 10, and a paint nozzle 20 connected to one end of the line 18. The feed line means 18 and all of the conducting coating material, such as water enamel or the like, and the spray head 12 are all at ground potential. Further, the article or object to be coated (not shown) for example, a part of an automobile body arranged at an axial distance in front of the spray head 12, is also at ground potential. The rotary atomizer driving unit 16 is electrically connected to the line 18.

The assembly 10 further includes a separate external housing 22 which encloses the rotary atomizer driving unit 16 and supports the spray head 12. The housing 22 has a front portion 24 and a rear portion 26. The housing 22 further includes grooves 28 between the front portion 24 and the rear portion 26 of the housing 22 filled with an insulating compound. The housing 22 is made of an insulating material, such as polyethylene terephtalate, or the like, and may be manufactured in separate parts to facilitate assembly. As an alternative, the rear portion 26 of the housing 22 may be made of metal, such as aluminum, resulting in a somewhat lower operating current.

The material of the external housing 18 should also be selected depending on the arrangement of the assembly 10. For example, the assembly 10 may be used alone or within a gorup of a plurality of atomizer assemblies 10 (not shown) arranged side by side by approximately in a common plane. If the axis of the atomizer assemblies 10 have a mutual distance from each other less than a predetermined minimum distance, for example, less than 15 times the diameter d of the spraying edge 14, at least the front portion 24 to the radial step 30 of the rear portion 26 of the housing 22 should be made of insulating material such as plastic. The distance aforementioned is the minimum for the danger of contamination of the assembly 10 by its respective neighboring assemblies 10.

The assembly 10 further includes electrode means 32 in spaced relationship circumferentially at uniformed angular intervals with respect to the spray head 12. Electrode means 20 is connected by a high voltage cable 34 to a source of high voltage potential to produce an electrical field charging the conductive material. In other words, since the spraying assembly 10 and the object to be coated are at ground potential, the assembly 10 includes high voltage electrode means 32 to produce the electrical field required to charge the coating material.

The electrode means 32 includes at least two and, at the most, three charging electrodes 36. With only one electrode 36, the spray head 12 would be contaminated, and the application efficiency would be low. However, these disadvantages would still arise with two electrodes 36, but to a substantially lesser degree. Also, when one spraying assembly 10 is being used alone, three electrodes 36 constitute the preferred or optimum arrangement, and any additional electrodes 36 would only increase the operating current. On the other hand, if, for example, a closed metal ring (not shown) were used as an external electrode instead of the electrodes 36 used in accordance with the subject invention, the application efficiency would be very low and there would be considerable contamination, not only of the metal ring, but also of the spraying head 12.

If, however, the spraying assembly 10 is arranged within a group or array of a plurality of spraying assemblies 10 mounted side by side and having their axis spaced from each other by a distance less than the minimum distance explained above so that there would be danger of mutual contamination, only two electrodes 36 for each assembly 10 constitutes the optimum.

Moreover, the electrode means 32 has a radial distance R between the electrode means 32 and the spraying edge 14 of the spray head 12 at least greater than twice the diameter d of the spraying edge 14 of the spray head 12. An optimal radial distance R between charging electrodes 36 and the spray head 12 is important. The radial distance R should be substantially greater than the diameter d of the spraying edge 14 of the spray head 12. As illustrated in FIG. 1, twice to four times the edge diameter d has been found desirable, with an optimum of about three times the diameter d. If a conventional spraying bell is used (discharge rate of the order of 120 cm/min), with a spraying edge 66 millimeters in diameter, the radial distance R between the electrode 36 and the axis of the spray head 12 may be about 225 millimeters, for example, (i.e., 192 mm from edge 14). If the distance R is too short, the field will be undesirably weak in the vicinity of the object to be coated. On the other hand, if the radial distance R is excessive, this may lead to contamination of the electrodes 36 or of the spray head 12.

The charging electrode 36 of the electrode means 32 also includes a tip portion 38 located axially rearward behind the plane of the spraying edge 14 of the spray head 12, a distance X not greater than half the radial distance R between the electrode means 32 and the spraying edge 14 of the spray head 12. Thus, it is desirable to arrange the tips 38 of the charging electrode 36 not in front of the plane of the spraying edge 14 of the spray head 12, but at least in this plane and preferably set back behind it. The setback should not be greater than half the radial distance R between electrodes 36 and the spraying edge 14 of the spray head 12. Preferably, the axial distance should be less than one fifth of that distance R. As illustrated in FIG. 1, the setback may amount to between 10 and 20 millimeters, or up to one tenth the radial distance R between electrodes 36 and the spraying edge 14 of the spray head 12. As the setback increases, the operating current becomes somewhat smaller. However, the application efficiency is reduced to a greater extent.

The electrode means 32 includes an electrode holder 40 having a radial portion 42 axially rearward of the spray head 12 and extending substantially radial or preferably perpendicular from the housing 22, and an axial portion 44 extending axially forward of the radial portion 42. Preferably, the radial portion 42 of the electrode holder 40 is longer than the axial portion 44. The electrode holder 40 further includes a holding part or portion 46 having a threaded portion 47 threadably removable in the free end of the axial portion 44. The electrode holder 40 is made of plastic.

The electrode means 32 includes a support ring 48 connected to and integral with the electrode holders 40. The support ring 48 is slipped onto the housing 22. The high voltage cable 34 is connected to each of the charging electrodes 36 and is continuously disposed within the electrode holder 40 and the support ring 48. In other words, the high voltage cable 34 runs to each charging electrode 36, and passes through the electrode holder 40 and the support ring 48 without interruption to the exterior thereof.

Figure 2:
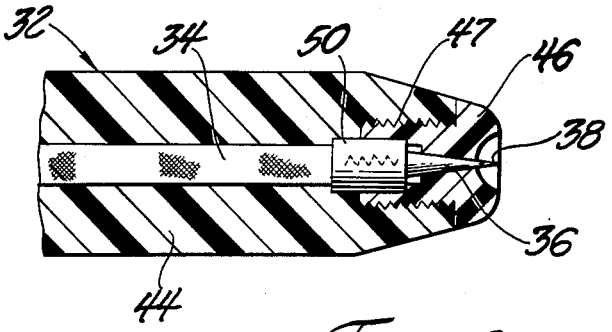
FIG. 2 is an enlarged view of the tip portion of the electrode holder of the subject invention.

The charging electrode 36 comprises a needle 36 made of metal, preferably hardened steel, 1.2 millimeters in diameter, having the tipped portion 38 at least axially flush with the axially forward end of the holding portion 46 of the electrode holder 40. The electrodes 36 are distributed at equal intervals circumferentially around the assembly 10. As illustrated in FIG. 2, only the outermost tipped portion 38 of the needle 36 is exposed within a small depression in the holding part 46 of the electrode holder 40. This reduces the danger of contamination of the electrodes 36 to a minimum. Instead of the arrangement shown, there are other ways of holding the charging electrodes 36 in the necessary position in relation to the spray head 12.

The assembly 10 further includes a high impedance-dampened resistor 50 interconnecting the cable 34 and the charging electrode 36. Put another way, each charging electrode 36 is connected in series with a high impedance dampening resistor 50 (e.g., of the order to 50 megohms) to the high voltage cable 34 which passes, without any brake or junction points, through electrode holder 40 to the outside of the housing 26, and if necessary, through a distributor feeding the other electrodes 36, to the high voltage source (not shown). The potential of the high voltage source may be negative or positive and may have a conventional value, for example 75 kV. Resistor 50 prevents rapid changes in current and reduces the operating current (by about 10%) with no appreciable reduction in charging efficiency.

Each of the three cables 34 running from the charging electrodes 36 may exit the retaining ring 48 at the base of the relevant electrode holder 40 and may be connected together at a distance from the assembly 10. It is also possible, however, to run the three cables 34 side by side, in an angular channel (not shown) in the retaining ring 48, at least partially around the periphery of the housing 22, and to connect them to each other, either in the angular channel, or preferably, in a feed tube (not shown) outside the retaining ring 48. In this case, the location of the joint will be embedded in a casting compound.

The external housing 26 further includes first deflecting gas ducts 52 having apertures 52' in spaced relationship circumferentially with respect to the axis of the housing 22. The apertures 52' of the ducts 52 have a radial distance from the axis of the housing 22 at least greater than the radius of the spraying edge 14 of the spray head 12. In other words, deflecting gas or air ducts 52 have apertures 52' which open radially, outward from the surface of the radial step 30 on the housing 22 facing the object to be coated. The apertures 52' of the ducts 52 are distributed circumferentially concentric to the spray head 12 at angular intervals (i.e., between 8° and 20°). These ducts 52 impact to the sprayed coating material an additional axial component of motion in the direction of the object to be coated in order to prevent contamination.

Figure 3:
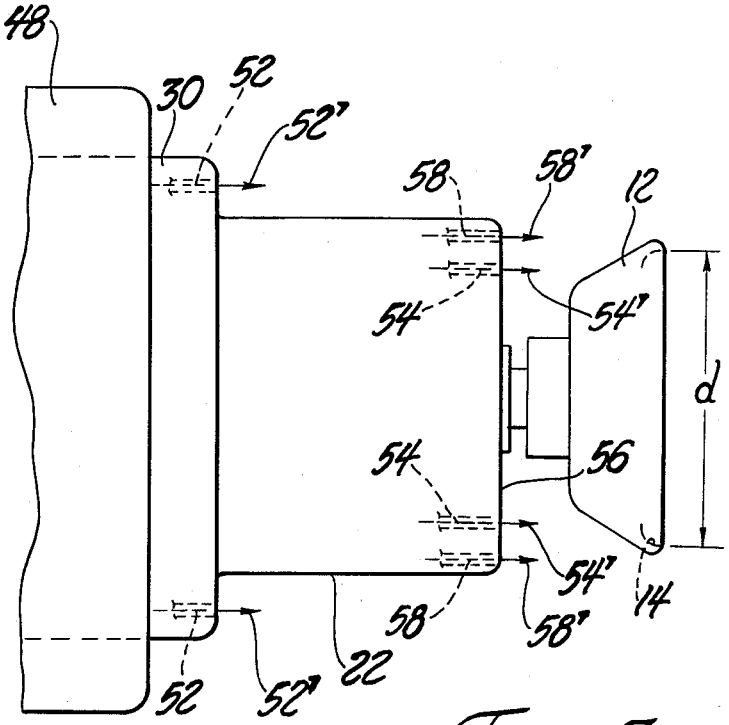
FIG. 3 is a partial elevational view of the housing of the subject invention.

Further, the external housing 26 includes second deflecting gas ducts 54 having apertures 54' located on the front face 56 of the front portion 24 of the housing 22 and have a radial distance from the axis of the housing 32 at least less than the radius of the spraying edge 14 of the spray head 12. In contrast to the first apertures 52', the second apertures 54' may be smaller than the radius of the spraying edge 14 of the spray head 12. As illustrated in FIG. 3, the external housing 26 may include third deflecting gas ducts 58 having third apertures 58' located on the front face 56 of the front portion 24 of the housing 22 and having a radial distance from the axis of the housing 26, at least greater than the radius of the spraying edge 14 of the spray head 12. Any combination of one, two or three of these possible gas ducts (52, 54, 58) and apertures (52', 54', 58') may be provided. In practice, the deflecting air may serve to reduce the danger of contamination, when an assembly 10 is used alone or in the event of a group or array of a plurality of assemblies 10 are used aforementioned.

In a practical test, with the assembly 10 optimized in the manner described for coating, for example, a grounded metal tube, located 300 millimeters in front of the spraying edge 14 with water enamel (with deflecting air at 120 kPa=1.2 bars), the application efficiency obtained was equal to that obtained with a conventional bell atomizer with the bell and the paint supply at high voltage and corresponding insulation. The advantage of eliminating this insulation resulted in only a disadvantage of a slightly higher operating current. Neither the electrodes 36 nor the spraying assembly 10 were appreciably contaminated with paint. Further, the electrode holder was not appreciably contaminated with paint due to its setback position in the area of lower field strength.

In a modified example of the embodiment of the assembly 10, the vertical portion 42 of the electrode holder 40 was inclined forwardly by a few degrees from the vertical. In this case, the field strength at the spraying edge 14 was somewhat less as compared with the case of the vertical arrangement of the vertical portion 42 of the electrode holder 40. Thus, paint particles reaching this area were deflected to a correspondingly greater extent towards the electrode holder 40.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be used in any way limiting, the invention may be practiced otherwise than as specifically described.

What is claimed is:

1. An electrostatic spray coating assembly (10) for atomizing electrically conductive material and depositing the atomized material upon the surface of an object, said assembly (10) comprising; a rotary atomizer spray head (12) having an annular atomizing spraying edge (14) with a predetermined diameter (d) for centrifugally atomizing the material and projecting the atomized material radially therefrom, an external housing (22) supporting said spray head (12), feed line means (18) for supplying the material from a supply system to said spraying edge (14) of said spray head (12), said feed line means (18) and the material supplied thereby and said spray head (12) being electrically grounded, electrode means (32) in spaced relationship circumferentially at uniform angular intervals with respect to said spray head (12), said electrode means (32) being connected to a source of high voltage potential for producing an electrical field charging the conductive material, said assembly (10) characterized by the electrode means (32) being positioned radially outwardly from said spraying edge (14) of said spray head (12) a predetermined radial distance (R) which is at least twice said predetermined diameter (d) of said spraying edge (14) of said spray head (12), said spraying edge (14) being positioned in a plane and defining the forward end of said assembly (10) and said electrode means (32) including a tip portion (38) located axially rearward from said forward end of said spraying edge (14) of said spray head (12) a distance (X) not greater than half said predetermined radial distance (R).

2. An assembly as set forth in claim 1 wherein said electrode means (32) includes three charging electrodes (36).

3. An assembly as set forth in claim 1 wherein said electrode means (32) further includes an electrode holder (40) having a radial portion (42) extending substantially radially from said external housing (22) and an axial portion (44) extending axially from said radial portion (42) toward said forward end.

4. An assembly as set forth in claim 3 wherein said electrode means (32) further includes a support ring (48) supporting said electrode holders (40), said support ring (48) being removably disposed onto said housing (26).

5. An assembly as set forth in 4 wherein said electrode means (32) includes three charging electrodes (36), each having a needle (36) disposed within said electrode holders (40), said axial portion (44) of said electrode holder (40) including a holding portion (46), said electrode (36) having said tip portion (38) located at least axially with the forward end of said holding portion (46) of said electrode holder (40).

6. An assembly as set forth in claim 5 wherein said electrode holder (40) is further characterized by said radial portion (42) being longer than said axial portion (44).

7. An assembly as set forth in claim 6 further including a high voltage cable (34) connected to each of said charging electrodes (36) and being continuously disposed within said electrode holder (40) and said support ring (48).

8. An assembly as set forth in claim 7 including a high impedance-dampening resistor (50) interconnecting said cable (34) and said charging electrode (36).

9. An assembly as set forth in claim 8 wherein said external housing (22) includes a front portion (24) made of an insulating material.

10. An assembly as set forth in claims 1 or 9 wherein said external housing (22) further includes deflecting gas ducts (52) having at least two of first apertures (52') in spaced relationship circumferentially with respect to the axis of said housing (28), said apertures (52') of said duct (52) having a radial distance from said axis of said housing (22) at least greater than the radius of said spraying edge (14) of said spray head (12), second deflecting gas ducts (54) having apertures (54) located on said front portion (24) of said housing (22) having a radial distance from said axis of said housing (22) at least less than the radius of said spray edge (14) of said spray head (12), and third deflecting gas ducts (58) having apertures (58') having a radial distance from said axis of said housing (22) at least greater than the radius of said spraying edge (14) of said spray head (12).

11. An assembly as set forth in claim 9 wherein said electrode holder (40) is made of a plastic material.

12. An assembly as set forth in claim 1, further including a plurality of assemblies (10) being adjacent one another in a common plane, said axis of said assemblies (10) being mutually spaced from each other a distance at least fifteen times said predetermined diameter (d) of said spraying edge (14) of said spray head (12).

* * * * *